US010568406B2

(12) United States Patent
Schreiber

(10) Patent No.: US 10,568,406 B2
(45) Date of Patent: Feb. 25, 2020

(54) BOTTLE FOR A COSMETIC PRODUCT, AND APPLICATOR ASSEMBLY COMPRISING A BOTTLE OF THIS KIND AND AN APPLICATOR FOR SAID COSMETIC PRODUCT

(71) Applicant: ALBEA SERVICES, Gennevilliers (FR)

(72) Inventor: Camille Schreiber, Paris (FR)

(73) Assignee: ALBEA SERVICES, Gennevilliers (FR)

( * ) Notice: Subject to any disclaimer, the term of this patent is extended or adjusted under 35 U.S.C. 154(b) by 150 days.

(21) Appl. No.: 15/602,315

(22) Filed: May 23, 2017

(65) Prior Publication Data

US 2017/0332767 A1 Nov. 23, 2017

(30) Foreign Application Priority Data

May 23, 2016 (FR) ..... 16 54594

(51) Int. Cl.

| | |
|---|---|
| ***A45D 34/04*** | (2006.01) |
| ***A45D 40/26*** | (2006.01) |
| ***B65D 41/04*** | (2006.01) |
| ***B65D 51/32*** | (2006.01) |

(52) U.S. Cl.

CPC ..... *A45D 40/267* (2013.01); *A45D 34/046* (2013.01); *B65D 41/04* (2013.01); *B65D 51/32* (2013.01)

(58) Field of Classification Search

CPC ..... A45D 34/045–047; A45D 40/265–268

USPC ..... 401/121–130

See application file for complete search history.

(56) References Cited

U.S. PATENT DOCUMENTS

| | | | | |
|---|---|---|---|---|
| 8,152,399 | B2 * | 4/2012 | Lasfargues | A45D 40/267 132/218 |
| 2003/0235454 | A1 * | 12/2003 | Gueret | A45D 40/267 401/126 |
| 2009/0320871 | A1 | 12/2009 | Bouix et al. | |
| 2011/0058889 | A1 * | 3/2011 | Hartstock | A45D 34/045 401/129 |
| 2011/0293352 | A1 | 12/2011 | Kim | |
| 2012/0177432 | A1 * | 7/2012 | Vanoncini | A45D 34/045 401/140 |

FOREIGN PATENT DOCUMENTS

| | | |
|---|---|---|
| EP | 1614367 | 1/2006 |

* cited by examiner

*Primary Examiner* — David J Walczak
*Assistant Examiner* — Joshua R Wiljanen
(74) *Attorney, Agent, or Firm* — Steven M. Greenberg, Esq.; Shutts & Bowen LLP

(57) ABSTRACT

A bottle for a cosmetic product is disclosed. The bottle is capable of occupying two positions, an opened position and a closed position. The bottle includes a body that extends along a main direction and has a distal end and a proximal end, and a side wall located between the distal end and the proximal end. The bottle also includes a cover, a wiper, opening and closing means located on the cover and on the body. The opening and closing means are positioned at a distance from the proximal end and from the distal end.

11 Claims, 3 Drawing Sheets

BOTTLE FOR A COSMETIC PRODUCT, AND APPLICATOR ASSEMBLY COMPRISING A BOTTLE OF THIS KIND AND AN APPLICATOR FOR SAID COSMETIC PRODUCT

CROSS REFERENCE TO RELATED APPLICATIONS

This application claims priority under 35 U.S.C. § 119(a) to French Patent Application Serial Number 654594, filed May 23, 2016, the entire teachings of which are incorporated herein by reference.

BACKGROUND OF THE INVENTION

Field of the Invention

The invention relates to a bottle for a cosmetic product. The invention also relates to an applicator assembly comprising such a bottle and an applicator for said cosmetic product.

Description of the Related Art

Applicator assemblies for cosmetic product that include an applicator which is capable of being detachably attached to a bottle containing the cosmetic product are known. In this regard, the bottle generally has a cover and a body. The cover is capable of being attached to the body of the bottle in such a way as to ensure a sealed closure of a cosmetic product container located inside the body of the bottle. The body, in turn, includes walls that define a container in which the cosmetic product is contained, and a mouth that defines an opening through which the cosmetic product can be removed. Indeed, the body is generally closed in the region of a first end by a bottom wall, and opened, by means of a mouth, in the region of a second end that is opposite to the first end. The body further includes a side wall that is located between the two ends so as to completely define the container.

The mouth, in turn, generally includes opening and closing means on the outer surface thereof, these means being capable of cooperating with complementary opening and closing means located on the inner surface of the cover in order to attach and close the cover in a sealed manner on the body of the bottle. When the mouth has cross sectional dimensions that are smaller than those of the cross section of the body of the bottle, it is referred to as the neck of the bottle. However, there are some disadvantages associated with the presence of a neck, and more particularly the presence of opening and closing means of the bottle that are located in the region of the neck, i.e. in the region of an opening of which the cross sectional dimensions are smaller than those of the cross section of the body of the bottle itself.

In particular, the presence of a neck can be a limiting factor for proposing applicators having large dimensions, and more particularly for applicators of which the tips have a large cross section. Indeed, manufacturers are constantly trying to diversify and to propose new types of applicators for consumers. Thus, said manufacturers do not want to be restricted by the dimensions of these applicator tips. The manufacturers are thus trying to increase the dimensions of the bottle openings, but without having to increase the overall body dimensions of said bottles.

As an additional matter, the wiper is generally located in the region of the neck of the bottle. This wiper is usually designed so as to cooperate with the cover in order to ensure a sealed closure of the bottle. In order to be able to increase the dimensions of the bottle opening, attempts have been made, for example, to over-mold the wiper in the region of the neck, to reduce the thickness of the wiper, or to assemble the wiper in the body of the bottle such that the wiper is prevented from rising up and engaging the neck.

BRIEF SUMMARY OF THE INVENTION

An object of the invention presents an alternative to the opening and closing system usually located in the region of the necks of the bottles.

The invention therefore relates to a bottle for a cosmetic product, the bottle being capable of occupying two positions, an opened position and a closed position. The bottle includes:

a body that is intended to contain the cosmetic product and that extends along a main longitudinal extension direction (X), referred to as the main direction, the body having a bottom wall at one of its ends, referred to as the distal end, and an opening at the opposite end along the main direction, referred to as the proximal end, and a side wall located between the distal end and the proximal end, a cover, a wiper that is intended to scrape off excess cosmetic product on an applicator when the bottle moves from the closed position to the opened position, the wiper being attached to the proximal end of the body, the wiper being designed so as to cooperate with the cover in order to ensure a sealed closure of the bottle in the closed position, opening and closing means located on the cover and on the body of the bottle, the opening and closing means being designed so as to cooperate with one another in order to ensure that the bottle is kept in the closed position.

According to the invention, the opening and closing means located on the body are positioned at a distance from the proximal end of the body and from the distal end of the body.

The solution of the invention, i.e. the presence of opening and closing means positioned at a distance from the proximal and distal ends of the body of the bottle, has a number of advantages.

This solution advantageously makes it possible to provide bottles that do not have a neck. Thus, the solution of the invention makes it possible to enlarge the opening of the bottles, but without increasing their overall dimensions, in particular the dimensions of the cross section of the body of the bottles. This means in addition that the applicators having large dimensions, in particular those applicators of which the tip has a large cross sectional dimension, can be easily inserted into these bottles without increasing the overall dimensions of the body thereof.

According to different embodiments of the invention (relating to the bottle), which can be taken together or in isolation:

the distance at which the opening and closing means are positioned on the body of the bottle can be established in accordance with a ratio of the heights h/H, in which the height h is the height between the proximal end and the opening and closing means located on the body, and the height H is the height of the body of the bottle between the distal and proximal ends, these two heights being measured along the main direction X, the ratio of the heights h/H being comprised between $0.25 \leq h/H \leq 0.75$, the distance at which the opening and closing means are positioned on the body of the bottle is established in accordance with the ratio comprised between $0.25 \leq h/H \leq 0.5$, the distance at which the opening and closing means are positioned on the body of the bottle is established in accordance with the ratio h=H/2, sealing of the bottle is ensured by the compression of the wiper between the proximal end of the body and the cover in the closed position of the bottle, the cover includes an outer surface, an inner surface and a solid part, the solid part of the cover is intended to ensure, together with the wiper, the sealing of the bottle in the closed position, the opening and closing means are located on the inner surface of the cover, and on the side wall of the body of the bottle, the side wall of the body has an outer surface and an inner surface, the opening and closing means are located on the outer surface of the side wall of the body of the bottle, the opening and closing means are selected from the group comprising a screw system, a bayonet system and a clip system, the screw system includes a tapped part located on the inner surface of the cover, and a threaded part located on the outer surface of the side wall of the body of the bottle.

The invention also relates to a cosmetic product applicator assembly that includes a bottle as described above and an applicator, with the cover being intended to keep the cosmetic product applicator inside the body when the bottle is in the closed position.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Figure 1:
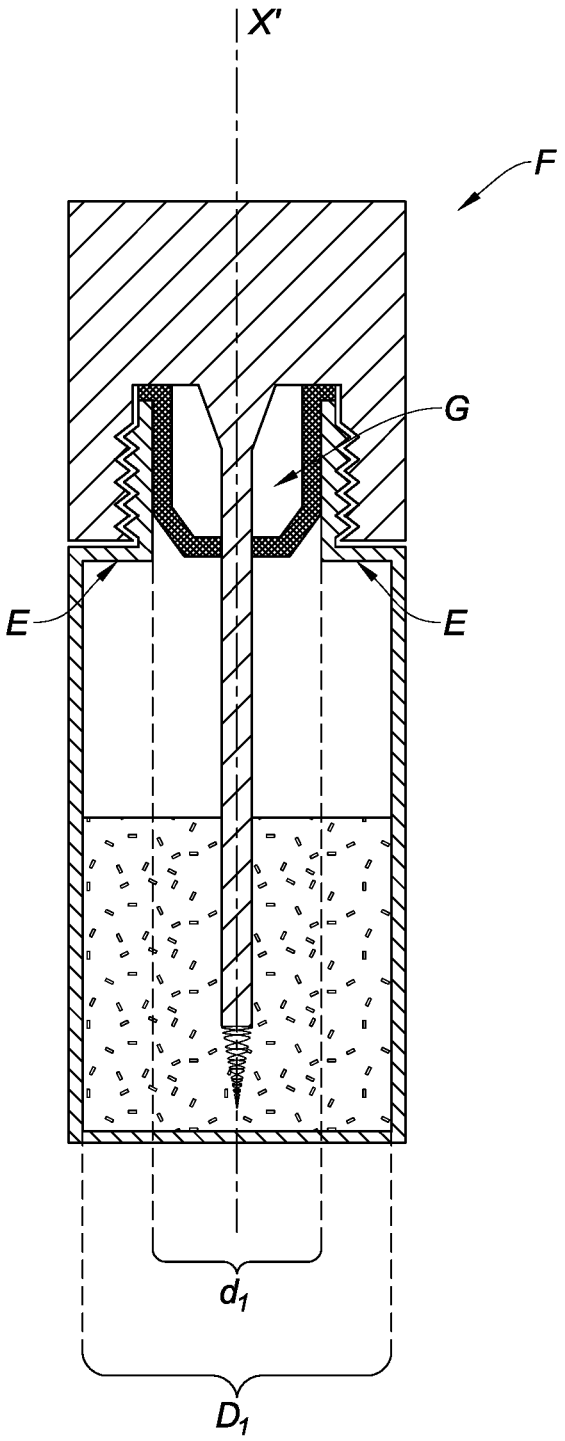
FIG. 1 is a longitudinal sectional view of a bottle known in the prior art supplied with a cosmetic product applicator.

FIG. 1 shows a bottle F from the prior art. In a general manner, this bottle F includes a body that is intended to contain a cosmetic product. This body extends along a main longitudinal extension direction X' and has a bottom wall at one of its ends, an opening at the opposite end along the main direction, and a side wall located between the two ends. This body further includes a shoulder E, i.e. a narrowing in its dimensions, for example in its diameter in the region of the top portion of the body, so as to make it possible to form a neck G to which the cover will be attached using opening and closing means located on the neck G and on the cover.

The invention, on the other hand, relates to a bottle 10 for a cosmetic product P that is capable of occupying two positions, an opened position and a closed position. "Opened position" means the position that the bottle occupies when a cover is detached from a body of the bottle. In contrast, "closed position" means the position that the bottle occupies when the cover is attached to the body of the bottle.

Figure 2:
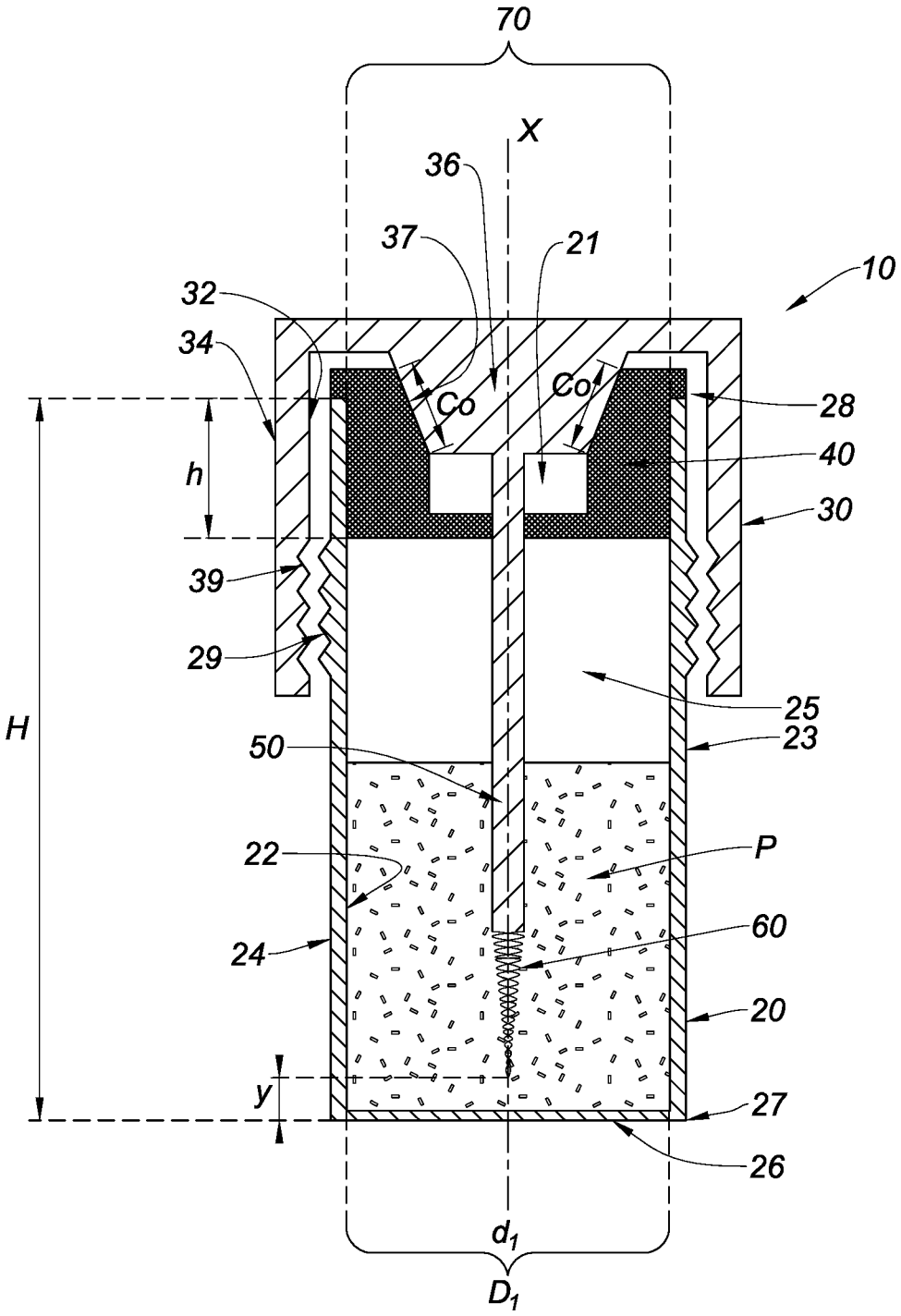
FIG. 2 is a longitudinal sectional view of a bottle according to a first embodiment of the present invention, the bottle being supplied with a cosmetic product applicator.

As shown in FIG. 2, the bottle 10 includes a body 20 that is intended, in a general manner, to contain the cosmetic product. The body 20 of the bottle 10 extends along a main longitudinal extension direction, referred to as the main direction and denoted X in FIGS. 2 and 3. In order to define a container 25 in which the cosmetic product (P) is contained, the body 20 has a bottom wall 26 at one of its ends, referred to as the distal end 27, and an opening 21 at the opposite end along the main direction, referred to as the proximal end 28, and a side wall 23 located between the distal end 27 and the proximal end 28. The side wall 23 has an inner surface 22 and an outer surface 24.

The opening 21 is delimited by what may be referred to as a bottle mouth. As mentioned above, the bottle F of the prior art includes a neck G. Indeed, the top portion of the body of the bottle F is provided with a shoulder E that makes it therefore possible to reduce the dimensions $d_1'$ of the opening of the bottle F with respect to the dimensions $D_1'$ of the body and therefore to form a neck ($d_1'<D_1'$). However, in contrast with the standard bottles of the prior art, the body 20 of the bottle 10 according to the invention does not include a shoulder in the region of the top portion of the body 20 of the bottle 10. "Shoulder" means the narrowing of the dimensions of the bottle in the region of the top portion of the body thereof so as to form a neck. In other words, the body 20 of the bottle according to the invention is straight or rectilinear between its distal end 27 and its proximal end 28. Taking the specific example of a bottle body and mouth that are both cylindrical along the main direction X and circular in cross section, the diameter $d_1$ of the mouth will have the same dimensions as the diameter $D_1$ of the body of the bottle ($d_1=D_1$). In other words, the diameter of the circular cross section of the mouth will be constant and not narrowed over the entire top portion of the body of the bottle.

The body 20 is advantageously a rigid part. "Rigid" means unable to be deformed either by atmospheric pressure or by a force exerted by the fingers of a user. Its cross section can be of any shape, in particular polygonal or circular. Preferably, the cross section of the body is circular.

The body 20 and the mouth 70 can be produced as a unique plastic piece. In a variant, the body 20 and the mouth 70 can be formed separately and then joined together by welding or by clipping, a seal being inserted between the two pieces.

The bottle 10 also includes a cover 30 that can be manipulated by a user and is intended to keep a cosmetic product applicator inside the body 20 when the bottle 10 is in the closed position.

The cover 30 is advantageously rigid. The cover has an inner surface 32, an outer surface 34 and a solid part 36 in its inside. The cross section of the cover can be of any shape, in particular polygonal or circular. Preferably, the cross section thereof is circular.

The solid part 36 of the cover 30 can, in particular, be in the shape of a truncated V (FIG. 2). In other words, the solid part 36 projects from the inner surface 32 of the cover 30. In other words, the V constitutes the continuation of the inner surface 32 of the cover 30 which stretches along the main direction X, the truncated portion of the V extending towards the inside of the container 25, when the bottle is in the closed position. Thus, on account of the V shape thereof, the solid part 36 has an oblique portion 37 which, as will be explained below, ensures a "conical" sealing of the bottle 10 in the closed position (FIG. 2).

Figure 3:
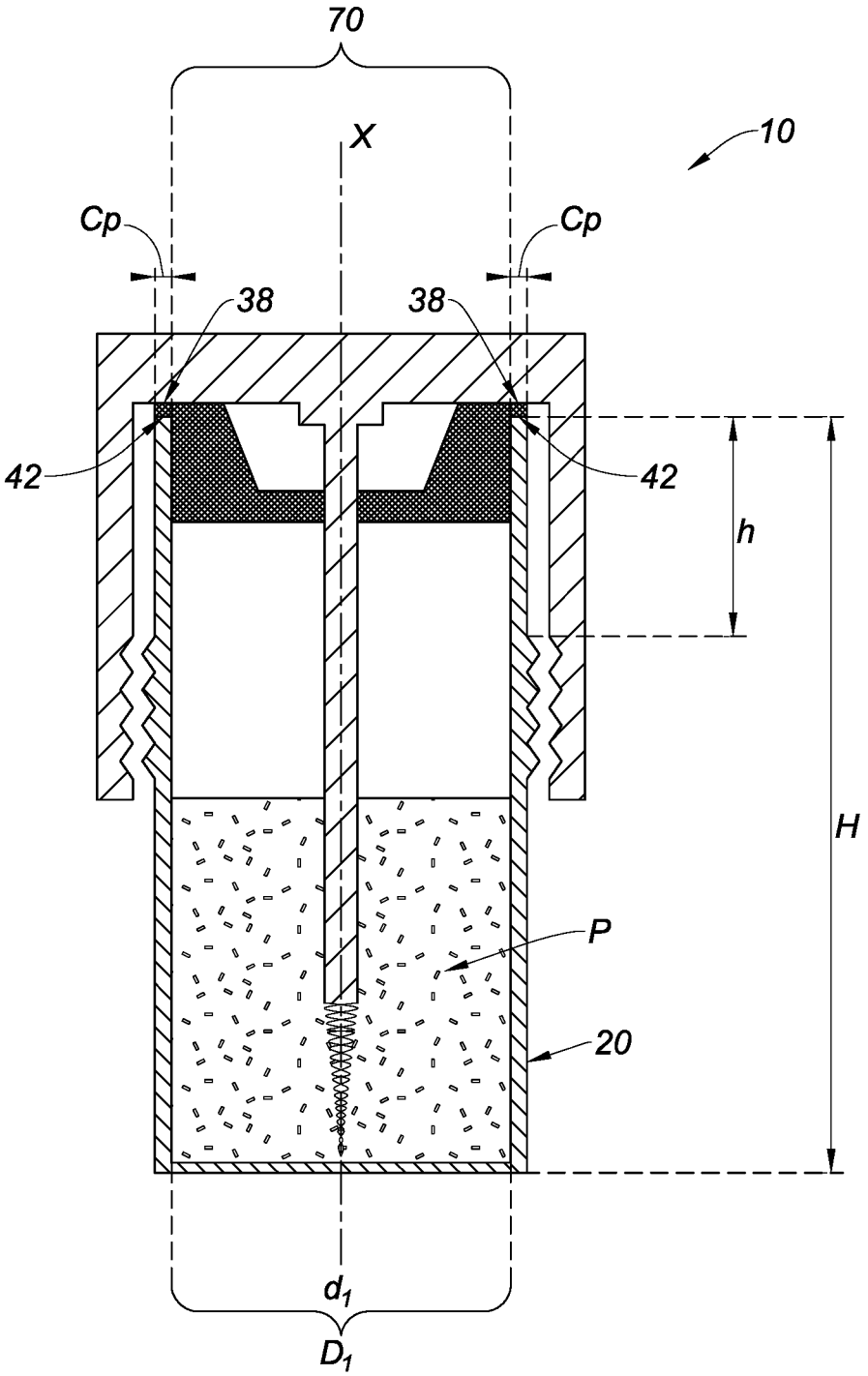
FIG. 3 is a longitudinal sectional view of a bottle according to a second embodiment of the present invention, the bottle being supplied with a cosmetic product applicator.

The solid part 36 of the cover can also be in the shape of a flat portion 38 (FIG. 3). This flat portion 38 also constitutes the continuation of the inner surface 32 of the cover 30. This flat portion 38 is perpendicular to the main direction X and is parallel with the top of the mouth 70 of the bottle 10, thus making it possible to ensure a "flat" sealing of the bottle 10 in the closed position, as described below (see FIG. 3).

The body 20 and the cover 30 are, for example, based on plastic material, in particular polypropylene. The parts are formed, in particular, by means of injection or injection blow moulding. The parts can be decorated, in particular by means of metallisation or by other means.

The bottle 10 also includes a wiper 40. The wiper 40 is usually attached to the proximal end 28 of the body 20. More particularly, the wiper is snapped in, adhesively bonded, or welded in the region of the mouth 70 of the bottle 10. The wiper 40 is, in particular, made of rubber.

This wiper 40 is intended to scrape off excess cosmetic product P on an applicator when the bottle 10 moves from a closed position to an opened position. Indeed, in order to prevent the applicator from being too loaded with cosmetic product, the bottle 10 usually includes a wiper 40 that is attached to the proximal end 28 of the body 20 and extends towards the inside of the container 25. When the user removes the applicator from the container 25, the applicator slides inside the wiper 40. The wiper 40 scrapes off excess cosmetic product P on the applicator, i.e. on a rod 50 and on an applicator tip 60 attached thereto. The wiper 40 thus makes it possible to control the amount of product which is present on the applicator tip 60 and prevents an excessive application of cosmetic product to the application surface.

The wiper 40 is also designed so as to cooperate with the cover 30 in order to ensure a sealed closure of the bottle 10 in the closed position. More particularly, the sealing of the bottle 10 is ensured by the compression of the wiper 40 between the proximal end 28 of the body 20 and the cover 30 in the closed position of the bottle 10. Yet more particularly, it is the solid part 36 of the cover 30 that is intended to ensure, together with the wiper 40, that the bottle 10 is sealed in the closed position. Indeed, as shown in FIGS. 2 and 3, the solid part 36 of the cover 30 makes it possible to ensure that the bottle 10 is sealed in the closed position. Depending on the shape of the solid part 36, this sealing can be referred to as "conical" (FIG. 2) or "flat" (FIG. 3).

When the sealing is referred to as "conical", this means that it is achieved by jamming and compressing the wiper 40 between the solid part 36 of the cover 30 and the inner surface 22 of the side wall 23 of the body 20 of the bottle 10 in the region of the proximal end 28 of the body 20, specifically at the moment the cover 30 is closed on the body 20 of the bottle 10 (FIG. 2). In other words, the wiper 40 will be crushed by the oblique portion 37 of the solid part 36 of the cover 30 and the inner surface 22 of the side wall 23 of the body 20 of the bottle 10. The contact regions between the wiper 40 and the oblique portion 37 of the solid part 36 of the cover 30 are denoted $C_o$ in FIG. 2.

When the sealing is referred to as "flat", this means that it is achieved by jamming and compressing the edge 42 of the wiper 40 between the solid part 36 of the cover 30 and the top of the mouth 70 of the bottle 10 at the moment the cover 30 is closed on the body 20 of the bottle 10 (FIG. 3). In other words, the wiper 40 will be crushed by the flat portion 38 of the solid part 36 of the cover 30 and the top of the mouth 70 of the bottle 10. The contact regions between the wiper 40 and the flat portion 38 of the solid part 36 of the cover 30 are denoted $C_p$ in FIG. 3.

The bottle 10 further includes opening and closing means 29, 39 that are located on the one hand on the cover 30 and on the other hand on the body 20 of the bottle, the opening and closing means 29, 39 being designed so as to cooperate with one another so to ensure that the bottle 10 is kept in the closed position.

More particularly, the opening and closing means 29, 39 are located on the one hand on the inner surface 32 of the cover 30 and on the other hand on the side wall 23 of the body 20 of the bottle 10. Even more particularly, the opening and closing means 29 are located on the outer surface 24 of the side wall 23 of the body 20 of the bottle 10.

Advantageously, the opening and closing means 29 located on the body 20 are positioned on the one hand at a distance from the proximal end 28 of the body 20 and on the other hand from the distal end 27 of the body 20. "At a distance" means that the opening and closing means 29 located on the body 20 of the bottle 10 are not located close to the proximal end 28 of the body 20 of the bottle 10. In other word, "at a distance" means that the opening and closing means 29 located on the body 20 are found deported on the one hand from the proximal end 28 of the body 20 and on the other hand from the distal end 27 of the body 20. "Deported" means that the opening and closing means 29 located on the body 20 are positioned in such a way that, on the one hand, they are not in direct contact with the proximal end 28 of the body 20 and, on the other hand, from the distal end 27 of the body 20. By way of example, the distance at which the opening and closing means 29 are positioned on the body 20 of the bottle 10 can be established in accordance with the following ratio of the heights h/H. In this ratio, the height h is defined as the height between the proximal end (28) and the opening and closing means (29) located on the body (20), whereas the height H is defined as the height of the body (20) of the bottle (10) between the distal (27) and proximal (28) ends, these two heights being measured along the main direction (X). According to the invention, this ratio must therefore be between $0.25 \leq h/H \leq 0.75$, more particularly between $0.25 \leq h/H \leq 0.5$ and even more particularly $h=H/2$.

It is important for this ratio of distances, h/H, to be respected so that the user can have access to the applicator tip 60 in order to apply make-up As mentioned above, the opening and closing means 29 located on the body 20 of the bottle 10 are designed so as to cooperate with corresponding opening and closing means 39 located on the cover 30 so to ensure that the bottle 10 is kept in the closed position. However, if the opening and closing means 29 located on the body 20 of the bottle 10 are located close to the distal end 27 of the body 20 of the bottle 10, in order for these opening and closing means 39 to correspond to those of the body 20 of the bottle 10, the cover 30 will have to be formed so as to almost completely cover the side wall 23 of the body 20 of the bottle 10. Given that the distance Y between the free end of the applicator tip 60 and the bottom 26 of the body of the bottle is generally very small (see FIG. 2), approximately 2 mm, the cover 30 will thus, in the opened position, cover almost all of the applicator tip 60, not allowing the user access to the applicator tip 60 in order to apply make-up. In other words, it is necessary to ensure that the opening and closing means 29 located on the body 20 of the bottle 10 cause a cover 30 to be formed, which cover allows sufficient closure of the bottle using the corresponding opening and closing means 39 located in the region of the cover 30, while allowing the user access to the applicator tip 60 in order to apply make-up when the bottle 10 is in the opened position. Thus, according to the invention, the ratio of the heights h/H is advantageously provided so as to allow make-up application in the opened position. Indeed, according to the invention, the opening and closing means 29 located on the body are not close to the distal end 27.

The opening and closing means 29, 39 include a screw system, the screw system comprising a tapped part 39 located on the inner surface 32 of the cover 30 and a threaded part 29 located on the outer surface 24 of the side wall 23 of the body 20 of the bottle 10.

In a variant, the opening and closing means 29, 39 include a bayonet system (not shown). The cover 30 can in particular have a protrusion on its inner surface 32 thereof, which protrusion will be inserted in a cam track (with or without rotation) located on the outer surface 24 of the side wall 23 of the body 20 of the bottle 10. In a variant, the protrusion and the cam track can be inverted, i.e. the protrusion would be located on the outer surface 24 of the side wall 23 of the body 20 of the bottle 10, and the cam track would be located on the inner surface 32 of the cover 30.

Alternatively, the opening and closing means 29, 39 include a clip system (not shown), also referred to as a snap system. For this purpose, the cover 20 can in particular include an annular groove on its inner surface 32 thereof, in which groove a ring located on the outer surface 24 of the side wall of the body of the bottle will be inserted. In a variant, teeth and/or slits may be used.

According to the invention, the sealing is also ensured both by the cooperation of the closing means located at a distance from the proximal and distal ends of the body of the bottle with the complementary means located in the region of the cover of the bottle, and also, when the cover has been attached to the body of the bottle using the above-mentioned closing means, by the cooperation of the cover and the wiper.

The invention further relates to a cosmetic product applicator assembly comprising a bottle 10 as described above and an applicator, the cover 30 being intended to keep the cosmetic product applicator inside the body 20 when the bottle 10 is in the closed position.

The applicator generally includes an axial rod 50 and an applicator tip 60. The axial rod 50 extends along a main longitudinal extension direction, in this case the main direction X, and includes two opposing ends. On account of its end referred to as the top end, the axial rod 50 is designed so as to rigidly connect the applicator to the cover 30. Moreover, by means of its bottom end or free end, the axial rod 50 is designed to be attached to the applicator tip 60. Since the applicator is generally rigidly connected to the cover 30, the applicator forms therewith a means for gripping the applicator. When the cover 30 is attached to the body 20 of the bottle 10, i.e. when the bottle 10 is in the closed position, the axial rod 50 and the applicator tip 60 extend inside the body 20 of the bottle 10. The applicator is thus immersed in the cosmetic product P contained in the container 25. In order to use the applicator, the user detaches the cover 30 from the body 20 and removes the applicator from the container 25. Reference is then made to the opened position of the bottle.

The rod 50 is advantageously rigid. The rod may be slightly deformed, in particular curved, under the effect of the forces applied while applying make-up, as a result of the elongate shape of the rod. The rod 50 is, for example, based on a plastic material, in particular polypropylene.

Depending on the intended uses, the applicator tip 60 may be a mascara brush, a brush for applying eyeliner, a lip balm spatula, or something else. Indeed, although it is in particular provided for applying mascara or eyeliner, the invention can also be used for any other kind of cosmetic product, in particular lip balm.

The materials used for the applicator tip 60 can be selected from the group comprising vegetable fibres (for example: cotton, rayon, cellulose), fibres made of a thermoplastic material (for example: polyamide, polyester, nylon), fibres made of an elastically deformable thermoplastic material (for example: elastomers, thermoplastic elastomers, vulcanised elastomers), a "sinter", and a foam (for example: polyurethane, polyethylene, polyvinyl chloride, polyether, NBR (natural rubber), SBR (synthetic rubber)). A "sinter" means a product obtained by consolidation, under the action of heat, of a more or less compact granular agglomerate, with or without fusion of one or more of its components thereof. In particular, any type of applicator tip 60 that forms a mascara brush can be used here, whether the tip be moulded or twisted and whether it has a straight or curved core.

Finally, the terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to embodiments thereof, it will be apparent that modifications and variations are possible without departing from the scope of the invention defined in the appended claims as follows:

1. A bottle for a cosmetic product, said bottle being capable of occupying two positions, an opened position and a closed position, said bottle comprising:

a body adapted to contain the cosmetic product and that extends along a main longitudinal extension direction, said body having a bottom wall at a distal end, and an opening at a proximal end along the main longitudinal extension direction and a side wall located between the distal end and the proximal end, a cover, a wiper adapted to scrape off excess cosmetic product on an applicator when the bottle moves from the closed position to the opened position, said wiper being attached to the proximal end of the body, the wiper cooperating with the cover in order to ensure a sealed closure of the bottle in the closed position, opening and closing means located on the cover and on the body of the bottle, the opening and closing means cooperating with one another in order to ensure that the bottle is kept in the closed position, wherein said opening and closing means are positioned at a distance from the proximal end of the body and from the distal end of the body and whereby the body of the bottle does not include a shoulder in the region of its top portion.

2. The bottle according to claim 1, wherein the distance at which the opening and closing means are positioned on the body of the bottle is established in accordance with a ratio of the heights h/H, in which the height h is a height between the proximal end and the opening and closing means located on the body, and the height H is a height of the body of the bottle between the distal and proximal ends, the heights h and H being measured along the main longitudinal extension direction, said ratio of the heights h/H being comprised between $0.25 \leq h/H \leq 0.75$.

3. The bottle according to claim 1, wherein the sealing is ensured by the compression of the wiper between the proximal end and the cover in the closed position of the bottle.

4. The bottle according to claim 1, wherein the cover comprises an outer surface, an inner surface and a solid part, said solid part ensuring, together with the wiper, the sealing of the bottle in the closed position.

5. The bottle according to the claim 4, wherein the opening and closing means are located on the inner surface of the cover, and on the side wall of the body of the bottle.

6. The bottle according to claim 5, wherein the side wall of the body has an outer surface and an inner surface, the opening and closing means being located on the outer surface of the side wall of the body of the bottle.

7. The bottle according to claim 1, wherein the opening and closing means is a screw system.

8. The bottle according to claim 7, wherein the screw system comprises a tapped part located on the inner surface of the cover, and a threaded part located on the outer surface of the side wall of the body of the bottle.

9. The bottle according to claim 1, wherein the opening and closing means is a bayonet system.

10. The bottle according to claim 1, wherein the opening and closing means is a clip system.

11. A cosmetic product applicator assembly, comprising:

an applicator; and, a bottle comprising:

a body adapted to contain the cosmetic product and that extends along a main longitudinal extension direction, said body having a bottom wall at a distal end, and an opening at a proximal end along the main longitudinal extension direction and a side wall located between the distal end and the proximal end, a cover, a wiper adapted to scrape off excess cosmetic product on the applicator when the bottle moves from the closed position to the opened position, said wiper being attached to the proximal end of the body, the wiper cooperating with the cover in order to ensure a sealed closure of the bottle in the closed position, opening and closing means located on the cover and on the body of the bottle, the opening and closing means cooperating with one another in order to ensure that the bottle is kept in the closed position, wherein said opening and closing means are positioned at a distance from the proximal end of the body and from the distal end of the body, wherein the body of the bottle does not include a shoulder in the region of its top portion; and wherein, the cover keeps the cosmetic product applicator inside the body when the bottle is in the closed position.

* * * * *